US010999666B2

(12) United States Patent
Hansson

(10) Patent No.: US 10,999,666 B2
(45) Date of Patent: May 4, 2021

(54) WATERPROOF MICROPHONE MEMBRANE FOR SUBMERSIBLE DEVICE

(71) Applicant: GoPro, Inc., San Mateo, CA (US)

(72) Inventor: Magnus Hansson, Los Altos, CA (US)

(73) Assignee: GoPro, Inc., San Mateo, CA (US)

( * ) Notice: Subject to any disclaimer, the term of this patent is extended or adjusted under 35 U.S.C. 154(b) by 721 days.

(21) Appl. No.: 15/726,149

(22) Filed: Oct. 5, 2017

(65) Prior Publication Data

US 2018/0103307 A1 Apr. 12, 2018

Related U.S. Application Data

(60) Provisional application No. 62/405,052, filed on Oct. 6, 2016.

(51) Int. Cl.

| | |
|---|---|
| ***H04R 1/04*** | (2006.01) |
| ***H04R 1/08*** | (2006.01) |
| ***G10K 11/00*** | (2006.01) |

(52) U.S. Cl.

CPC ..... *H04R 1/086* (2013.01); *G10K 11/006* (2013.01); *H04R 1/04* (2013.01); *H04R 2499/11* (2013.01)

(58) Field of Classification Search

CPC . H04R 1/08; H04R 1/04; H04R 1/086; H04R 249/11; G10K 11/00; G10K 11/006

See application file for complete search history.

(56) References Cited

U.S. PATENT DOCUMENTS

| | | | | |
|---|---|---|---|---|
| 3,738,248 | A * | 6/1973 | Fish | G03B 17/08 396/28 |
| 6,958,255 | B2 * | 10/2005 | Khuri-Yakub | B06B 1/0688 438/118 |
| 8,477,983 | B2 * | 7/2013 | Weigold | H04R 19/005 381/369 |
| 8,975,984 | B2 * | 3/2015 | Huang | B81B 3/0027 333/186 |
| 9,239,386 | B2 * | 1/2016 | Elian | G01S 15/08 |
| 9,471,142 | B2 * | 10/2016 | Chizeck | G06T 15/405 |
| 9,811,121 | B2 * | 11/2017 | Cardinali | H04R 7/00 |
| 2003/0047380 | A1 * | 3/2003 | Stuart | G10K 11/17857 181/206 |
| 2005/0024755 | A1 * | 2/2005 | Tichy | B63C 11/52 359/845 |
| 2006/0004289 | A1 * | 1/2006 | Tian | B06B 1/0292 600/459 |

(Continued)

FOREIGN PATENT DOCUMENTS

DE 102006058736 B3 * 1/2008 ..... B63G 8/39

*Primary Examiner* — Isam A Alsomiri
*Assistant Examiner* — Amie M Ndure
(74) *Attorney, Agent, or Firm* — Young Basile Hanlon & MacFarlane, P.C.

(57) ABSTRACT

An audio capture device for a submersible camera including a supporting structure to prevent a waterproof membrane from deflecting beyond a point that will cause damage to the membrane. A microphone assembly includes a microphone for detecting ambient sound and generating an electrical signal representing the ambient sound. The microphone assembly is covered by a waterproof membrane to prevent water from reaching the microphone assembly. One or more supporting rings near the waterproof membrane prevents the waterproof membrane from deflecting more than a threshold deflection.

20 Claims, 8 Drawing Sheets

(56) References Cited

U.S. PATENT DOCUMENTS

| | | | | |
|---|---|---|---|---|
| 2008/0141921 | A1* | 6/2008 | Hinderks | F01L 3/02 114/274 |
| 2009/0241753 | A1* | 10/2009 | Mann | G10D 17/00 84/384 |
| 2010/0026809 | A1* | 2/2010 | Curry | H04N 5/232 348/157 |
| 2010/0207484 | A1* | 8/2010 | Chang | B06B 1/0292 310/300 |
| 2011/0228074 | A1* | 9/2011 | Parulski | H04N 21/42202 348/81 |
| 2012/0227389 | A1* | 9/2012 | Hinderks | F01L 1/146 60/317 |
| 2013/0088941 | A1* | 4/2013 | Elian | H01L 41/0973 367/99 |
| 2013/0170109 | A1* | 7/2013 | Cohen | H04M 1/03 361/679.01 |
| 2013/0284537 | A1* | 10/2013 | LoPresti | H04R 19/04 181/171 |
| 2015/0146905 | A1* | 5/2015 | Abe | H04R 1/086 381/334 |
| 2016/0094911 | A1* | 3/2016 | Kropf | H04R 1/44 381/334 |
| 2016/0378142 | A1* | 12/2016 | Cardinali | H04R 1/086 361/679.56 |
| 2019/0283841 | A1* | 9/2019 | Farrell, III | B25H 1/0071 |

* cited by examiner

WATERPROOF MICROPHONE MEMBRANE FOR SUBMERSIBLE DEVICE

RELATED APPLICATIONS

This application claims the benefit of U.S. Provisional Application No. 62/405,052 filed on Oct. 6, 2016 which is incorporated by reference herein.

BACKGROUND

Field of Art

The disclosure generally relates to audio systems and in particular to a supporting structure for a waterproof microphone membrane.

Description of Art

In a waterproof camera or other submersible audio device, a protective membrane may be placed in front of the microphone to prevent water from reaching the microphone. If the device is submerged, the membrane may deflect from the water pressure. If the membrane deflects too far, it may become irreparably damaged and thus fail to protect the device from water penetration or interfere with audio quality.

BRIEF DESCRIPTION OF THE DRAWINGS

The disclosed embodiments have advantages and features which will be more readily apparent from the detailed description, the appended claims, and the accompanying figures (or drawings). A brief introduction of the figures is below.

DETAILED DESCRIPTION

The figures and the following description relate to preferred embodiments by way of illustration only. It should be noted that from the following discussion, alternative embodiments of the structures and methods disclosed herein will be readily recognized as viable alternatives that may be employed without departing from the principles of what is claimed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

Configuration Overview

An audio capture device for a submersible camera includes a supporting structure to prevent a waterproof membrane from deflecting beyond a point that will cause damage to the membrane. A microphone assembly includes a microphone for detecting ambient sound and generating an electrical signal representing the ambient sound. The microphone assembly is mounted on a printed circuit board. A first supporting ring is coupled to a top surface of the printed circuit board via a first adhesive layer. The first supporting ring has an opening over the microphone assembly. A waterproof membrane is coupled to the top surface of the first supporting ring via a second adhesive layer. The waterproof membrane vibrates in response to the ambient sound. The first supporting ring prevents the waterproof membrane from deflecting more than a threshold deflection. A housing has an opening to enable the ambient sound to reach the microphone assembly through the waterproof membrane. The housing houses the waterproof membrane and the microphone assembly.

Audio Sub-System Architecture

Figure 1:
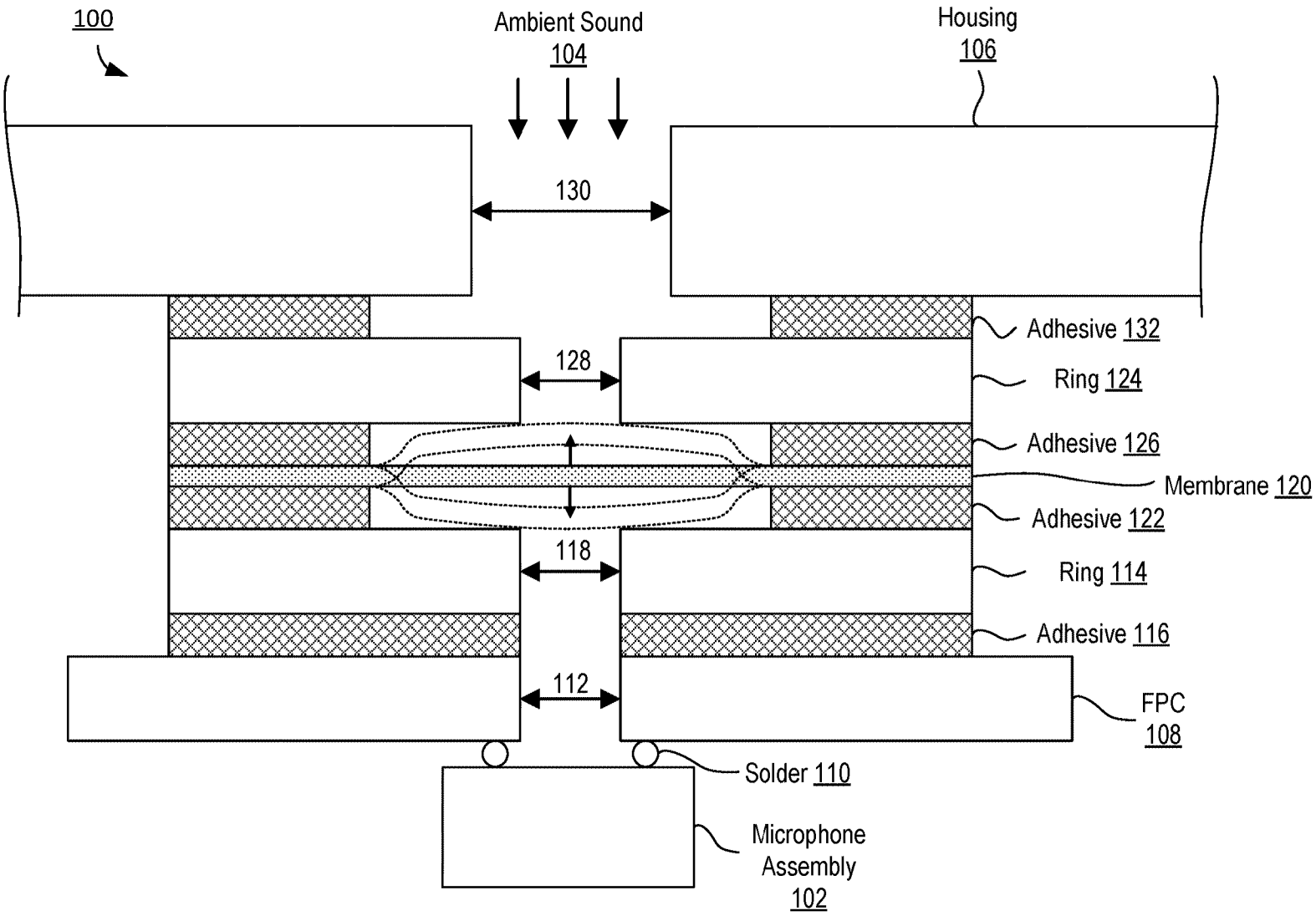
FIG. 1 is a cross-sectional diagram illustrating a first embodiment of an audio sub-system for a submersible device.

FIG. 1 illustrates a cross-sectional view of an embodiment of an audio sub-system 100 for a submersible camera or other audio device. The audio sub-system 100 comprises a microphone assembly 102 including one or more microphones to convert ambient sound 104 entering an opening 130 in the housing 106 to an electrical signal that can be captured and stored as one or more audio channels. The microphone assembly 102 is coupled to a bottom side of a flexible printed circuit board (FPC) 108 (e.g., via solder or other securing mechanism 110). The FPC 108 may include various other electronic components (not shown) to support the audio capture function. For example, the FPC 108 may include an audio processor, memory, and/or persistent storage, and electrical connections between the components. The FPC 108 includes an opening 112 over the microphone assembly 102 to enable ambient sound 104 to reach the microphone assembly 102. A first plastic ring 114 (e.g., a polyethylene terephthalate (PET)) ring) is coupled to a top side of the FPC 108 via a first adhesive layer 116. The first plastic ring 114 may comprise an opening 118 to enable ambient sound 104 to reach the microphone assembly 102. A waterproof membrane 120 is coupled to the top side of the first plastic ring 114 via a second adhesive layer 122. The waterproof membrane 120 may prevent water from outside of the housing 106 from reaching the microphone assembly 102, while enabling ambient sound 104 to pass through without substantially affecting the audio quality. A second plastic ring 124 is coupled to the top side of the waterproof membrane 120 via a third adhesive layer 126 and is coupled to the bottom side of the housing 106 via a fourth adhesive layer 132. The second plastic ring 124 may comprise an opening 128 to enable the ambient sound 104 to reach the microphone assembly 102. The second plastic ring 124 is coupled to an interior surface of the housing 106. The housing 106 may similarly include an opening 130 to enable ambient sound 104 to reach the microphone assembly 102.

In an embodiment, the openings 112, 118, 128, 130 are at least partially aligned with each other and with the microphone assembly 102 so that the ambient sound 104 has a direct path to the microphone assembly 102. Alternatively, one or more openings 112, 118, 128, 130 may be offset from each other as described in further detail below with respect to FIG. 6.

In one embodiment, the waterproof membrane 120 comprises a PTFE air permeable waterproof material. The waterproof membrane 120 may be flexible and may vibrate in response to the ambient sound 104. When submerged under water, the waterproof membrane 120 may deflect towards the first plastic ring 114 from the water pressure outside the membrane 120 being higher than air pressure inside the membrane 120, thus stretching the membrane. Furthermore, in situations where air pressure inside the membrane 120 is higher than air pressure outside the membrane 120 (e.g., in high altitude), the membrane 120 may deflect towards the second plastic ring 124. The waterproof membrane 120 may have a material property such that if the amount of deflection is less than a threshold amount, the waterproof membrane can return to its equilibrium position without damaging the membrane 120. However, if the membrane 120 is sufficiently stretched such that the deflection exceeds the threshold, the waterproof membrane 120 may become permanently damaged and may not return to its equilibrium position. If the membrane is damaged, this may cause a reduction in audio quality or may cause the membrane 120 to fail to prevent water penetration.

The waterproof membrane 120 may be held in place using adhesives layers 122, 126 formed in respective rings having larger inner diameters than the inner diameters of the first and second plastic rings 114, 124. Thus, the portion of the membrane 120 that is free to vibrate may have a larger diameter than the inner diameter of the first and second plastic rings 114, 124. In one embodiment, the size of the inner diameter of the first and second plastic rings 114, 124 and the thicknesses of the second and third adhesive layers 122, 126 are configured such that the membrane 120 is free to vibrate with an amplitude sufficiently large to prevent the membrane 120 from causing a substantial reduction in audio quality, but is prevented from being deflected past the threshold deflection amplitude that damages the membrane. Particularly, the first plastic ring 114 limits how far the membrane 120 can deflect in a first direction when pressure is higher outside the membrane 120 than inside the membrane 120 (e.g., when submerged), while the second plastic ring 124 limits how far the membrane 120 can deflect in a second direction when pressure is higher inside the membrane 120 than outside the membrane 120 (e.g., in high altitude). For example, as illustrated in the dashed lines of FIG. 1, the membrane 120 may vibrate up or down within a limited range, but the plastic rings 114, 124 provides a support structure that prevents the membrane 120 from being deflected too far in either direction.

Figure 2:
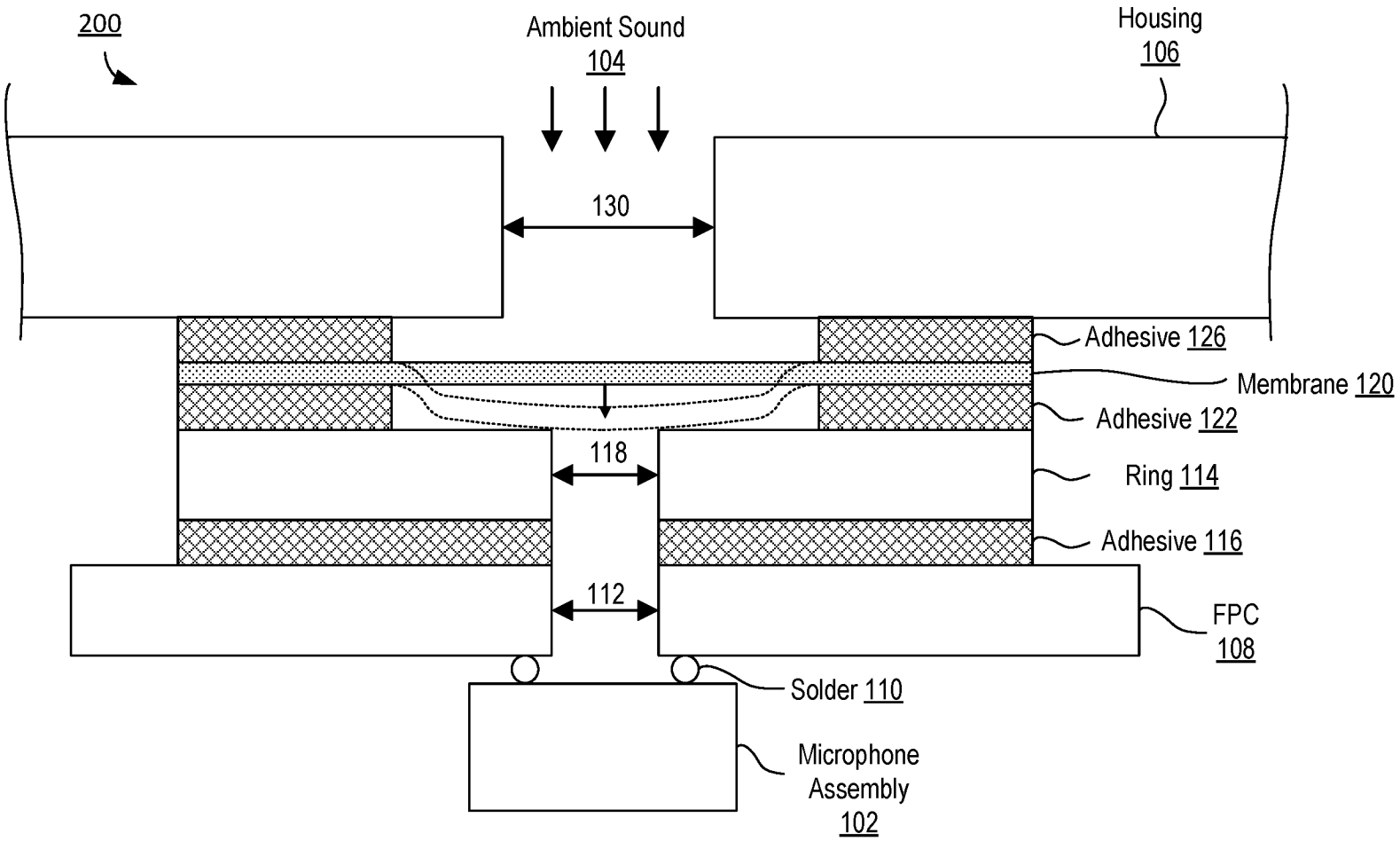
FIG. 2 is a cross-sectional diagram illustrating a second embodiment of an audio sub-system for a submersible device.

FIG. 2 illustrates another embodiment of an audio sub-system 200. The embodiment of FIG. 2 is similar to the embodiment of FIG. 1, but lacks the second plastic ring 124 above the membrane 120 and lacks the fourth adhesive layer 132. Instead the membrane 120 is coupled directly to the bottom side of the housing 106 via the third adhesive layer 126. This embodiment may be used when it is expected that large deflections in the membrane will occur only in the direction of the microphone assembly 102, and thus the second plastic ring 124 above the membrane 120 may not be necessary to prevent deflection in the direction of the housing 106. For example, water pressure from water entering the opening 130 of the housing 106 when the audio sub-system 200 is submerged may deflect the membrane 120 only in the direction of the microphone assembly 102.

Figure 3:
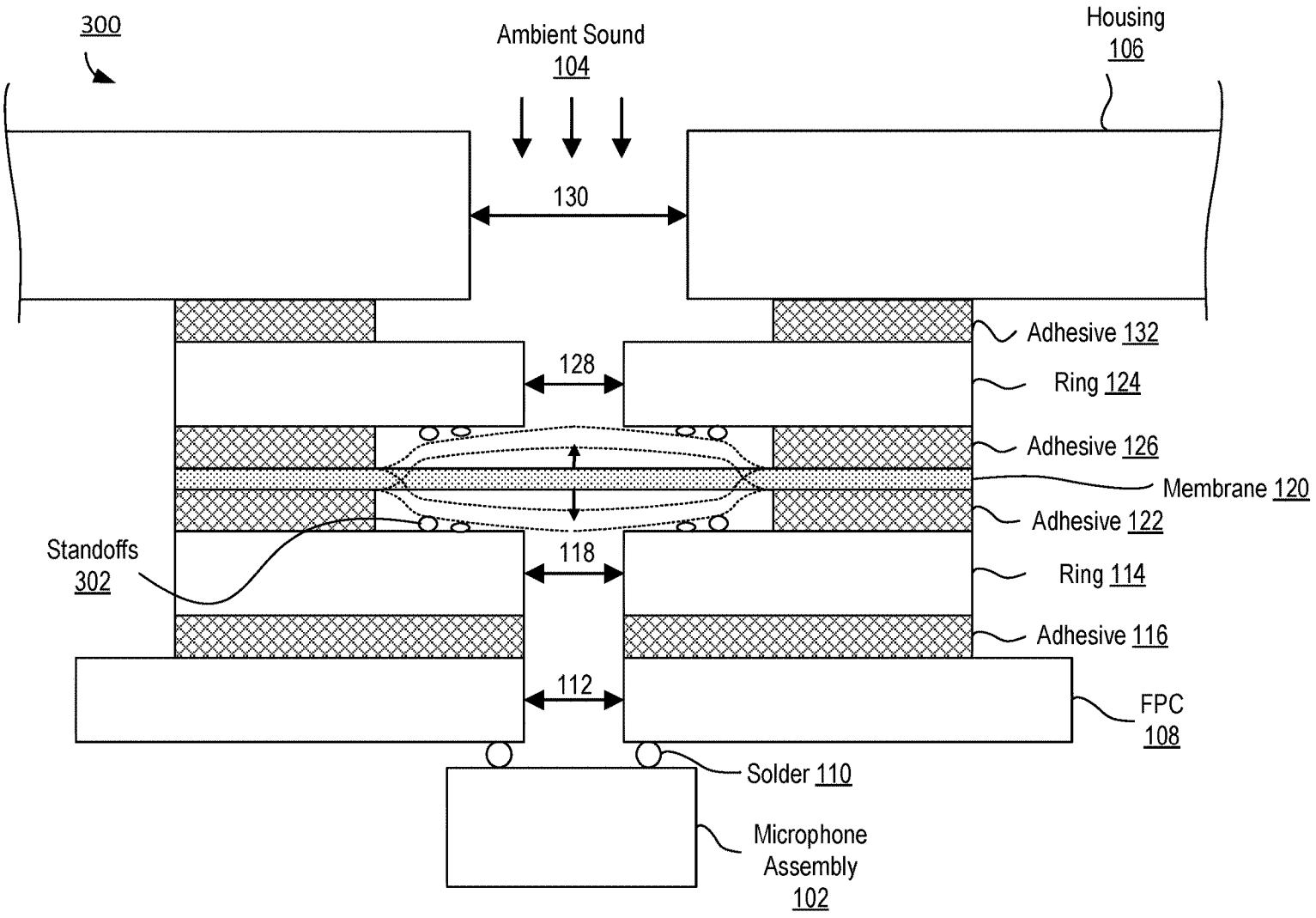
FIG. 3 is a cross-sectional diagram illustrating a third embodiment of an audio sub-system for a submersible device.

FIG. 3 illustrates another embodiment of an audio sub-system 300. The embodiment of FIG. 3 is similar to the embodiment of FIG. 1 but the plastic rings 114, 124 each include standoff structures 302 protruding from their respective surfaces that face the membrane 120. The standoff structures 302 provide points of contact for the microphone membrane 120 when a large deflection occurs. The standoff structures 302 may comprise a non-stick material to prevent that membrane 120 from adhering to the support structures 302 when they become in contact.

Figure 4:
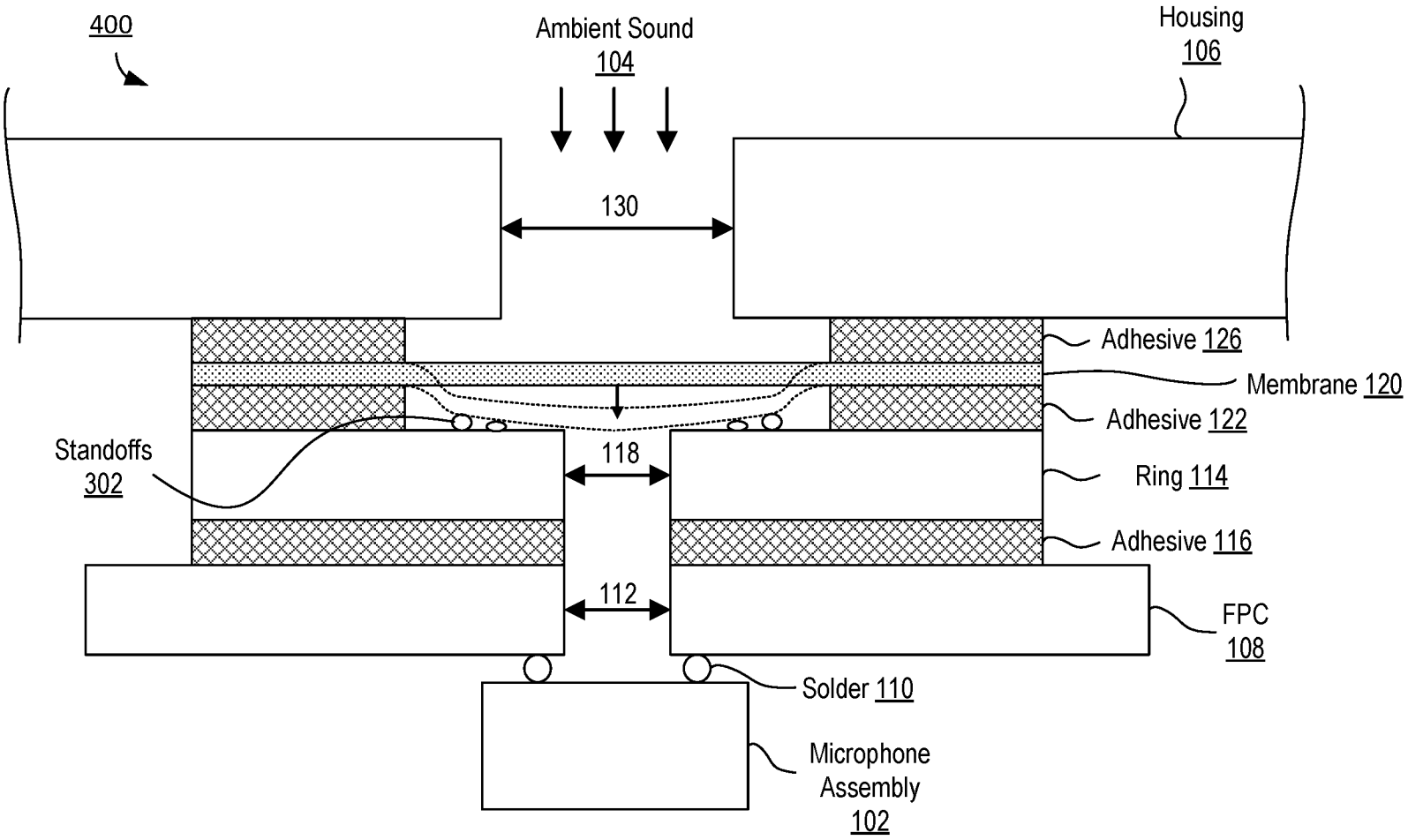
FIG. 4 is a cross-sectional diagram illustrating a fourth embodiment of an audio sub-system for a submersible device.

FIG. 4 illustrates another embodiment of an audio sub-system 400. The embodiment of FIG. 4 is similar to the embodiment of FIG. 2 but the plastic ring 114 includes standoff structures 302 similar to those described above.

Figure 5:
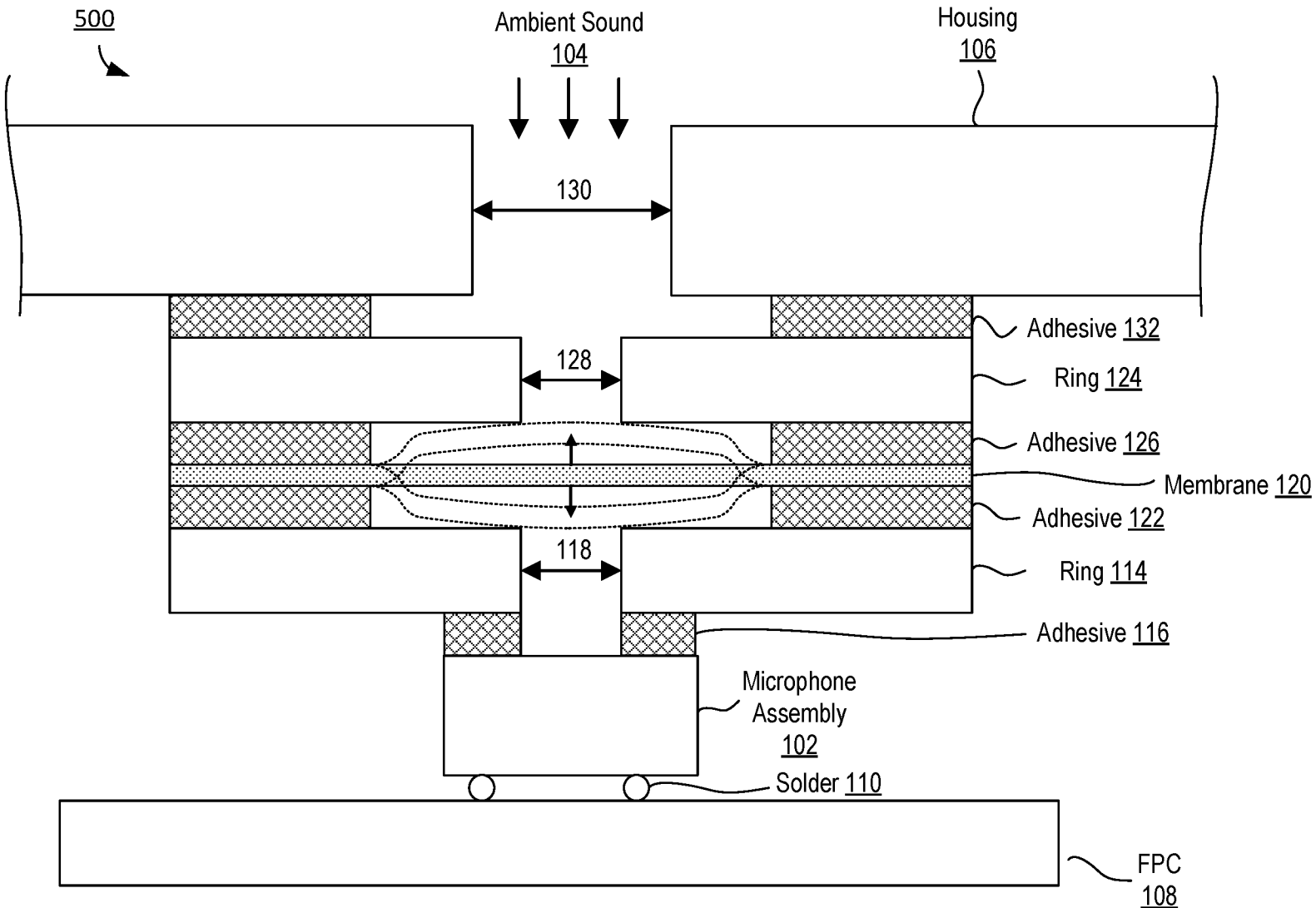
FIG. 5 is a cross-sectional diagram illustrating a fifth embodiment of an audio sub-system for a submersible device.

FIG. 5 illustrates another embodiment of an audio sub-system 500. This embodiment, is similar to the embodiment of FIG. 1, except the microphone assembly 102 is coupled to the first plastic ring 114 via the adhesive layer 116, and the FPC 108 is coupled to the bottom side of the microphone assembly 102. Furthermore, in this embodiment, the FPC 108 does not necessarily include an opening 112. In other embodiments, the configuration of the adhesive layer 116, microphone assembly 102, and FPC 108 shown in the embodiment of FIG. 5 may be substituted for the adhesive layer 116, microphone assembly 102, and FPC 108 in any of the embodiments of FIGS. 2-4.

Figure 6:
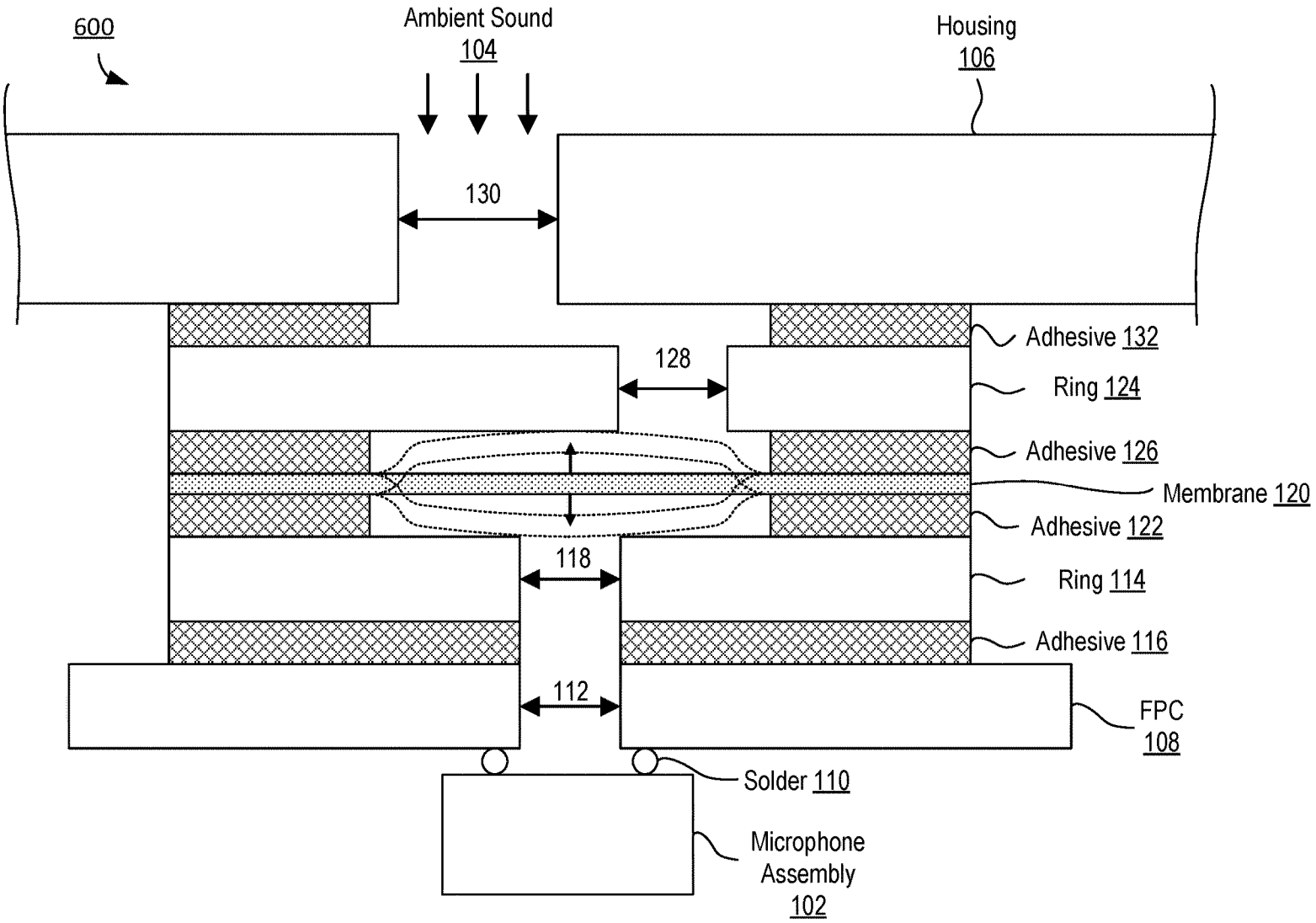
FIG. 6 is a cross-sectional diagram illustrating a sixth embodiment of an audio sub-system for a submersible device.

FIG. 6 illustrates yet another embodiment of an audio sub-system 600. In this embodiment, at least two of the openings 112, 118, 128, 130 are misaligned with each other. For example, in the illustrated embodiment, opening 130 is misaligned with opening 128. In alternative variations, the openings 112, 118, 128, 130 may be placed at any position so long as they are within the openings of the surrounding adhesive rings (e.g., adhesive 132, 126, 122, 116). These embodiments may beneficially prevent high speed water jets from entering the opening 130 and damaging the membrane 120 because the water jet will be blocked from its direct path to the membrane 120. The embodiments of FIG. 2-5 or other variations thereof may similarly be modified to include one or more offset pairs of openings 112, 118, 128, 130.

Figure 7:
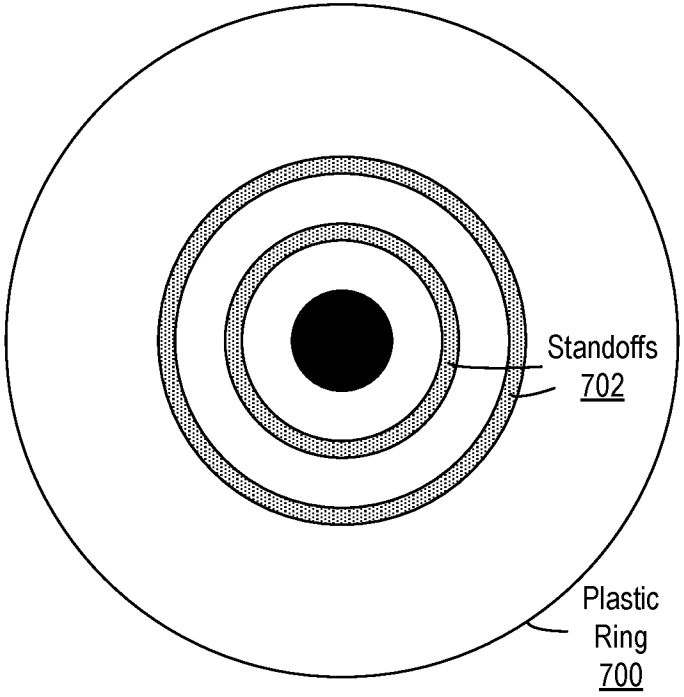
FIG. 7 is a planar view of a first embodiment of a ring support structure for supporting a membrane in an audio sub-system.

FIG. 7 is a planar view of a first embodiment of a plastic ring 700 including standoff structures 702 protruding from its surface as described above. In this embodiment, the standoffs 702 structured may comprise raised concentric rings protruding from a surface of the ring 700 at varying distances from the center.

Figure 8:
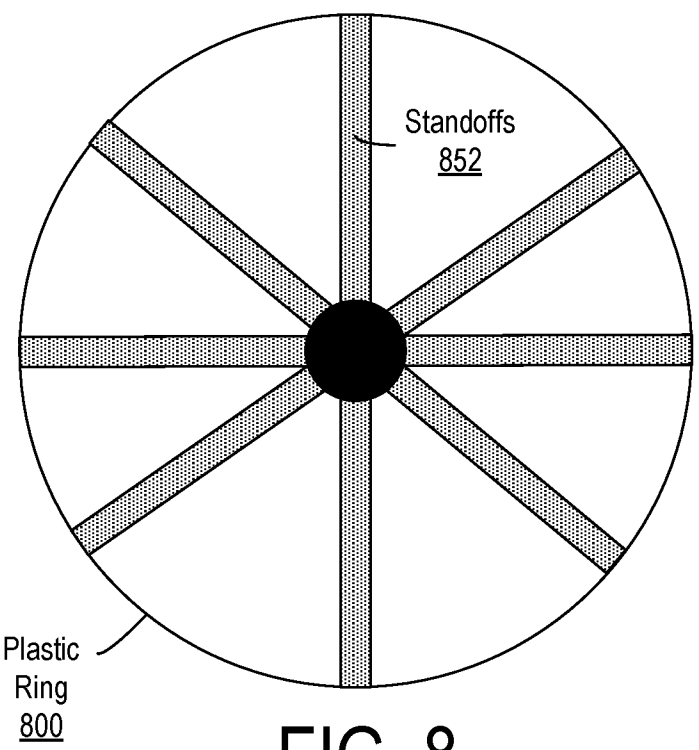
FIG. 8 is a planar view of a second embodiment of a ring support structure for supporting a membrane in an audio sub-system.

FIG. 8 is a planar view of a second embodiment of a plastic ring 800 including standoff structures 802 protruding from its surface. In this embodiment, the standoff structures 802 may comprise bars arranged in a star pattern. For example, each standoff 502 may comprise a raised structure between a center opening of the ring 800 and an edge of the ring 800.

Figure 9:
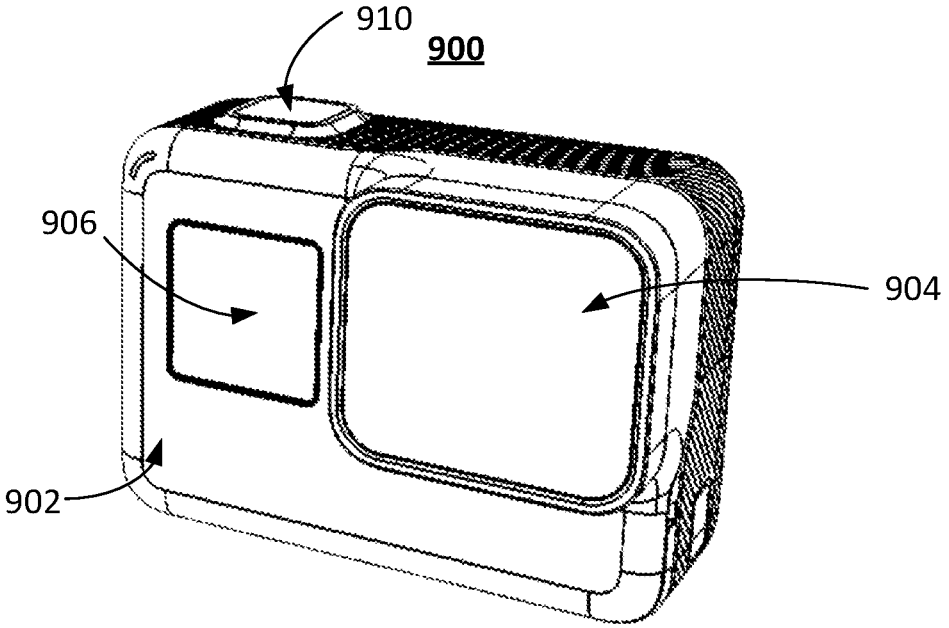
FIG. 9 is an example embodiment of a submersible camera that houses an audio sub-system.

FIG. 9 illustrate an embodiment of an example camera 900 that may include any of the audio sub-systems 200, 200, 300, 400, 500, 600 or other variations thereof described above. The camera 900 may comprise a camera body 902 having a camera lens 904 structured on a front surface of the camera body, various indicators on the front of the surface of the camera body 902 (such as LEDs, a display 906, and the like), various input mechanisms (such as buttons, switches, and touch-screen mechanisms), and electronics (e.g., imaging electronics, power electronics, etc.) internal to the camera body 902 for capturing images via the camera lens and image sensor and/or performing other functions. The camera 900 may be configured to capture images and video, and to store captured images and video for subsequent display or playback.

The camera 900 can include various indicators, including a display panel 906. The camera 900 can also include buttons 910 configured to allow a user of the camera to interact with the camera, to turn the camera on, and to otherwise configure the operating mode of the camera.

In an alternative embodiment, the audio sub-systems 100, 200, 300, 400, 500, 600 or other variations thereof described herein, may be integrated into an audio capture device that is not necessarily a camera.

Additional Configuration Considerations

Throughout this specification, some embodiments have used the expression "coupled" along with its derivatives. The term "coupled" as used herein is not necessarily limited to two or more elements being in direct physical or electrical contact. Rather, the term "coupled" may also encompass two or more elements are not in direct contact with each other, but yet still co-operate or interact with each other, or are structured to provide a drainage path between the elements.

Likewise, as used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Upon reading this disclosure, those of skill in the art will appreciate still additional alternative structural and functional designs as disclosed from the principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

The invention claimed is:

1. An audio capture device comprising:

a microphone assembly including a microphone for detecting ambient sound and generating an electrical signal representing the ambient sound;

a printed circuit board on which the microphone assembly is mounted;

a first supporting ring coupled above the printed circuit board and the microphone assembly via a first adhesive layer, the first supporting ring having an opening over the microphone assembly and including one or more standoff structures;

a waterproof membrane coupled to a top surface of the first supporting ring via a second adhesive layer, the waterproof membrane to vibrate in response to the ambient sound, wherein the first supporting ring prevents the waterproof membrane from deflecting more than a threshold deflection;

a housing having an opening to enable the ambient sound to reach the microphone assembly through the waterproof membrane, the housing to house the waterproof membrane and the microphone assembly.

2. The audio device of claim 1, wherein the second adhesive layer comprises a ring having a larger interior diameter than an interior diameter of the first supporting ring.

3. The audio device of claim 1, wherein the first supporting ring comprises a first plurality of standoffs protruding from a top surface of the first supporting ring, the standoffs to contact the waterproof membrane when the waterproof membrane undergoes a deflection in a direction towards the first supporting ring.

4. The audio device of claim 3, wherein the first plurality of standoffs comprises a plurality of raised concentric rings around the opening in the first supporting ring.

5. The audio device of claim 3, wherein the first plurality of standoffs comprises a plurality of raised bars between the opening of the first supporting ring and an edge of the first supporting ring.

6. The audio device of claim 1, further comprising:

a second supporting ring coupled to a top surface of the waterproof membrane via a third adhesive layer and coupled to the interior surface of the housing via a fourth adhesive layer, the second supporting ring having an opening over the microphone assembly.

7. The audio device of claim 6, wherein the second adhesive layer comprises a ring having a larger interior diameter than an interior diameter of the first supporting ring and wherein the third adhesive layer comprises a ring having a larger interior diameter than an interior diameter of the second supporting ring.

8. The audio device of claim 6, wherein the first supporting ring comprises a first plurality of standoffs protruding from a top surface of the first supporting ring, and wherein the second supporting ring comprises a second plurality of standoffs protruding from a bottom surface of the second supporting ring.

9. The audio device of claim 1, wherein the printed circuit board is coupled to the first supporting ring via the first adhesive layer, wherein the printed circuit board comprises a printed circuit board opening, and wherein the microphone assembly is coupled to a bottom side of the printed circuit board under the printed circuit board opening.

10. The audio device of claim 1, wherein a top surface of the microphone assembly is coupled to the first supporting ring via the first adhesive layer, and wherein a bottom surface of the microphone assembly is mounted to the printed circuit board.

11. The audio device of claim 1, wherein the opening of the first supporting ring is laterally offset from at least one other opening in an audio path from the opening in the housing to the microphone assembly.

12. A camera comprising:

an image sensor to capture video frames of a video;

a microphone assembly including a microphone for detecting ambient sound and generating an electrical signal representing the ambient sound;

an audio processor to generate an audio channel of the video based on the electrical signal;

a printed circuit board on which the microphone assembly is mounted;

a first supporting ring coupled over the printed circuit board and the microphone assembly via a first adhesive layer, the first supporting ring having an opening over the microphone assembly and including one or more standoff structures;

a waterproof membrane coupled to a top surface of the first supporting ring via a second adhesive layer, the waterproof membrane to vibrate in response to the ambient sound, wherein the first supporting ring prevents the waterproof membrane from deflecting more than a threshold deflection;

a housing having an opening to enable the ambient sound to reach the microphone assembly through the waterproof membrane, the housing to house the waterproof membrane and the microphone assembly.

13. The camera of claim 12, wherein the first supporting ring comprises a first plurality of standoffs protruding from a top surface of the first supporting ring, the standoffs to contact the waterproof membrane when the waterproof membrane undergoes a deflection in a direction towards the first supporting ring.

14. The camera of claim 13, wherein the first plurality of standoffs comprises a plurality of raised concentric rings around the opening in the first supporting ring.

15. The camera of claim 13, wherein the first plurality of standoffs comprises a plurality of raised bars between the opening of the first supporting ring and an edge of the first supporting ring.

16. The camera of claim 12, further comprising:

a second supporting ring coupled to a top surface of the waterproof membrane via a third adhesive layer and coupled to the interior surface of the housing via a fourth adhesive layer, the second supporting ring having an opening over the microphone assembly.

17. The camera of claim 16, wherein the second adhesive layer comprises a ring having a larger interior diameter than an interior diameter of the first supporting ring and wherein the third adhesive layer comprises a ring having a larger interior diameter than an interior diameter of the second supporting ring.

18. The camera of claim 16, wherein the first supporting ring comprises a first plurality of standoffs protruding from a top surface of the first supporting ring, and wherein the second supporting ring comprises a second plurality of standoffs protruding from a bottom surface of the second supporting ring.

19. An audio capture device comprising:

an audio capture means for detecting ambient sound and generating an electrical signal representing the ambient sound;

an electrical component supporting means for supporting the audio capture means and associated electronics;

a waterproofing means for preventing water from reaching the audio capture means, the waterproofing means vibrating in response to the ambient sound;

a first supporting means for supporting the waterproofing means, the first supporting means coupled over the electrical component supporting means and the audio capture means via a first adhesive means, the first supporting means having an opening over the audio capture means and including one or more standoff structures, wherein the first supporting means prevents the waterproofing means from deflecting more than a threshold deflection;

a housing means for housing the waterproofing means and the audio capture means, the housing means having an opening to enable the ambient sound to reach the audio capture means through the waterproofing means.

20. The audio device of claim 19, further comprising:

a second supporting means for supporting the waterproofing means, the second supporting means coupled to a top surface of the waterproofing means via a third adhesive means and coupled to the interior surface of the housing via a fourth adhesive means, the second supporting means having an opening over the audio capture means.

* * * * *